United States Patent [19]

Musso

[11] Patent Number: 4,605,324

[45] Date of Patent: Aug. 12, 1986

[54] ELECTRONIC TYPEWRITER WITH A DEVICE FOR ZERO POSITIONING OF A ROTARY CHARACTER-CARRYING DEVICE

[75] Inventor: Pietro Musso, Ivrea, Italy

[73] Assignee: Ing. C. Olivetti & C., S.p.A., Ivrea, Italy

[21] Appl. No.: 795,759

[22] Filed: Nov. 8, 1985

Related U.S. Application Data

[63] Continuation of Ser. No. 582,611, Feb. 22, 1984, abandoned.

[30] Foreign Application Priority Data

Feb. 22, 1983 [IT] Italy ..... 67196 A/83

[51] Int. Cl.[4] ..... B41J 1/30

[52] U.S. Cl. ..... 400/144.2; 400/185; 400/187; 400/212; 400/697

[58] Field of Search ..... 400/143, 144, 144.1, 400/144.2, 144.3, 144.4, 154.5, 155, 184, 185, 187, 211, 212, 214, 696, 697, 697.1; 101/93.18, 93.19, 93.20, 93.21, 99

[56] References Cited

U.S. PATENT DOCUMENTS

| | | | |
|---|---|---|---|
| 4,264,220 | 4/1981 | Okcuoglu | 400/144.2 |
| 4,299,502 | 11/1981 | Harre | 400/144.2 |
| 4,472,073 | 9/1984 | Valle et al. | 400/697.1 |

FOREIGN PATENT DOCUMENTS

| | | | |
|---|---|---|---|
| 2919209 | 11/1980 | Fed. Rep. of Germany | 400/144.2 |
| 2067472 | 7/1981 | United Kingdom | 400/144.2 |

OTHER PUBLICATIONS

R. F. Springer, "Printwheel Removal and Ribbon Cartridge Lifting Mechanism"; *IBM Tech. Disc. Bull.*, vol. 23, No. 4, p. 1516; Sep. 1980.

J. R. Booth, "Means and Method for Homing Daisy Wheel Printers"; *IBM Tech. Disc. Bull.;* vol. 24, No. 12, pp. 6536–6537; May 1982.

*Primary Examiner*—Edgar S. Burr
*Assistant Examiner*—David A. Wiecking
*Attorney, Agent, or Firm*—Banner, Birch, McKie & Beckett

[57] ABSTRACT

The electronic typewriter is of the 'daisywheel' type and comprises a microprocessor, a stepping selector motor controlled by a position register for positioning the daisywheel 28, and a support frame for a correction ribbon. The support frame is arranged to oscillate from a down position for viewing purposes to an up position for the correction operation. A tab (104) moves up and down with the frame. The daisywheel rotates together with a sleeve member 97 provided with a stop seat 98. The tab (104), in the up position, urges a tooth (99) on a lever (101) into interference with the sleeve member (97), via a resiliently yielding blade (107) of the lever (101). During the correction cycles, rotary movement of the daisywheel (28) takes place when the support frame and hence the tab (104) is in its own position and thus without any obstacle. In the initialization phase, the microprocessor raises the support frame and tab (104) in advance of a command for complete rotation of the daisywheel (28). This causes the tooth (99) to engage into the seat (98) and stops the daisywheel in its zero position. The position register is then loaded with a code corresponding to the zero position of the daisywheel, thereby being synchronized to the angular position thereof.

22 Claims, 7 Drawing Figures

ELECTRONIC TYPEWRITER WITH A DEVICE FOR ZERO POSITIONING OF A ROTARY CHARACTER-CARRYING DEVICE

This application is a continuation, of application Ser. No. 582,611, filed Feb. 22, 1984, now abandoned.

The present invention relates to an electronic typewriter with a device for zero positioning of a rotary character-carrying member, e.g., 'daisywheel', with which the machine is fitted.

The character-carrying members of modern printers or typewriters are generally controlled by servo motors, either of the open loop type or of the closed loop type, which are controlled by incremental angular position counters. When starting the machine, the character-carrying member has to be moved into a zero position and the content of the counter has to be synchronised with the zero position of the character-carrying member. That is effected by causing the character-carrying member to perform a complete revolution and by providing a transducer which detects the zero position thereof for zeroing the counter. That construction is rather expensive.

A device for zero positioning of a character-carrying disc, of the 'daisywheel' type, is known, which is carried by a carriage that is movable in front of the typing platen roller. A stop element rotates together with the daisywheel and is capable of co-operating with a fixed stop member disposed on a side portion of the machine. During the initialisation operation, the carriage is caused to move to a limit position towards the stop element and the disc is caused to rotate at low speed. After a period of time sufficient for a rotary movement through 360°, the stop element is certain to have engaged the fixed stop member, so stopping the disc. The position counter is then synchronised with the zero position of the disc and the carriage moves away from the end-of-travel position. That device suffers from the disadvantage of making synchronisation of the daisywheel dependent on the movement of the carriage and requiring the carriage to cover a greater distance than that required for the printing cycles.

An object of the present invention is therefore to provide a device for zero positioning of a rotary character-carrying member which is of moderate cost and dimensions, which is reliable, and which does not give rise to disadvantages during normal functioning of the machine. That object is achieved by the device according to the present invention, which is characterised by the characterising portions of the main claims.

A preferred embodiment of the invention is illustrated by the following description which is given by way of nonlimiting example and with reference to the accompanying drawings in which.

Figure 1:
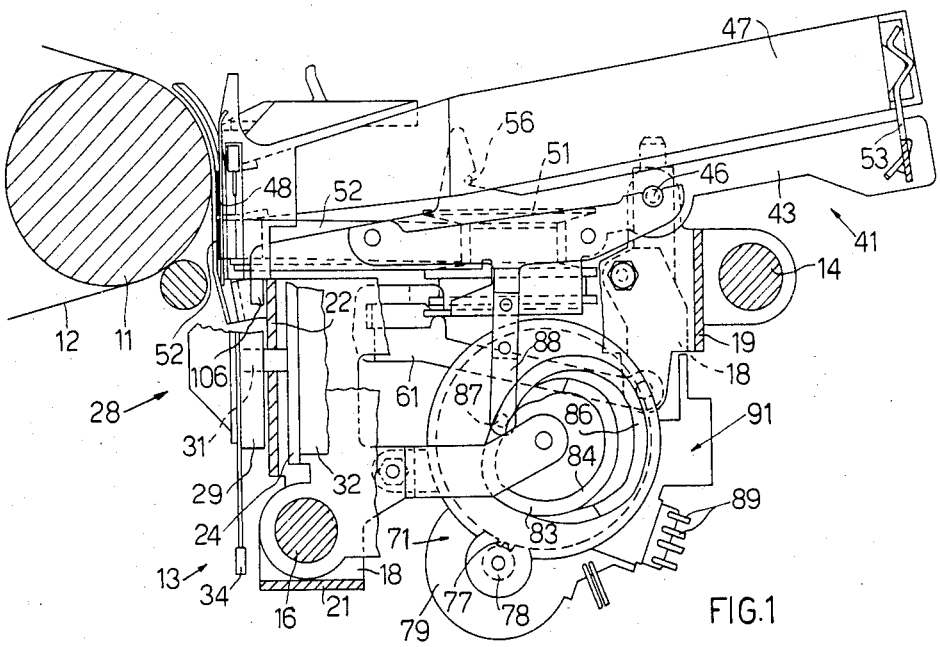
FIG. 1 shows a view in longitudinal section of part of an electronic typewriter on which the zero positioning device according to the invention is mounted.
Figure 6:
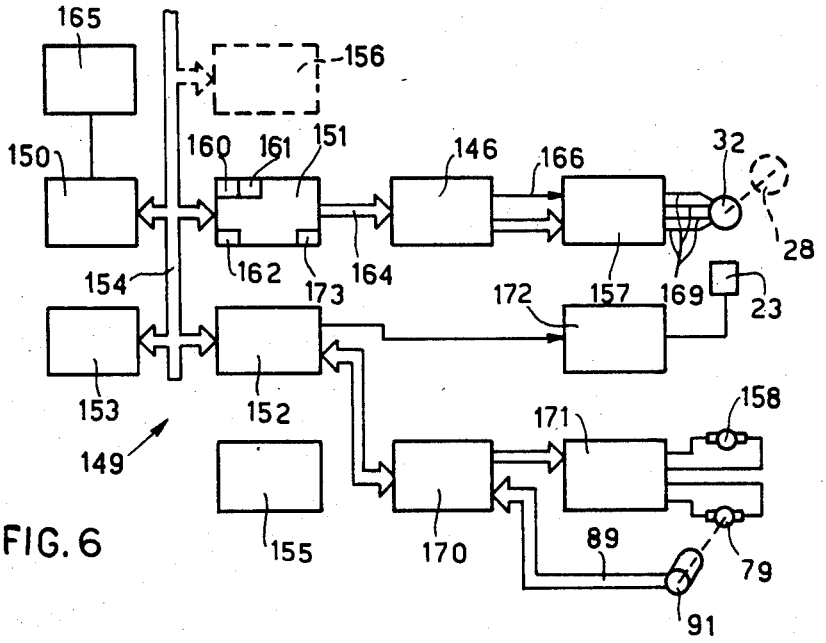
Figure 7:
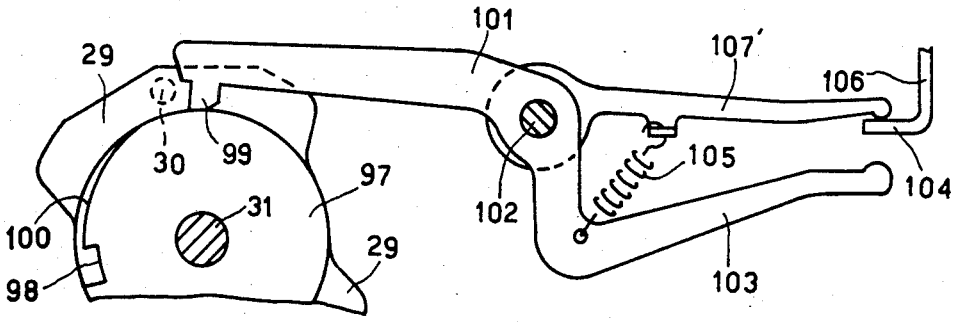
Figure 3:
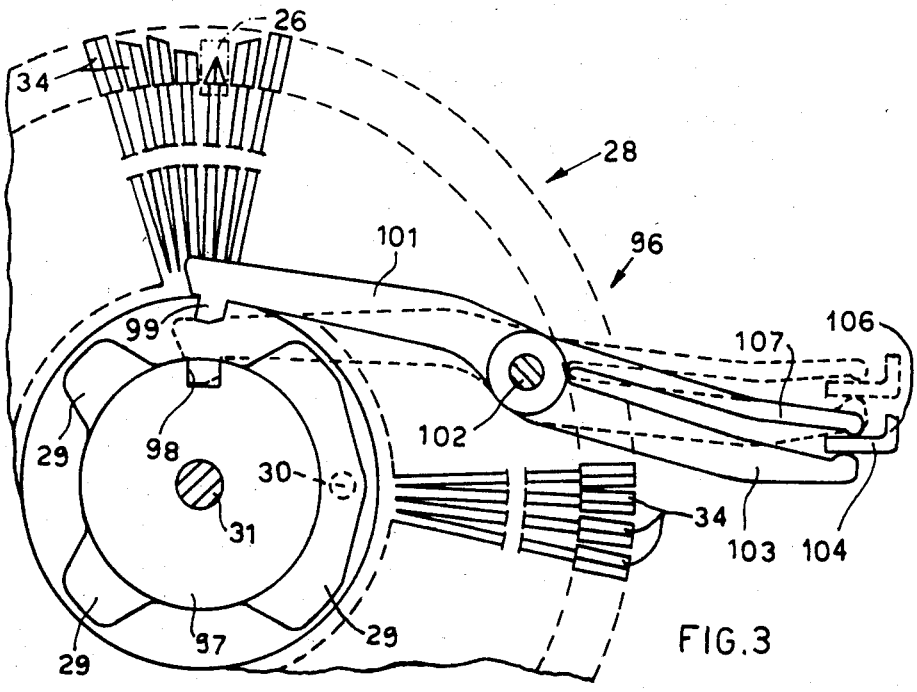
Figure 4:
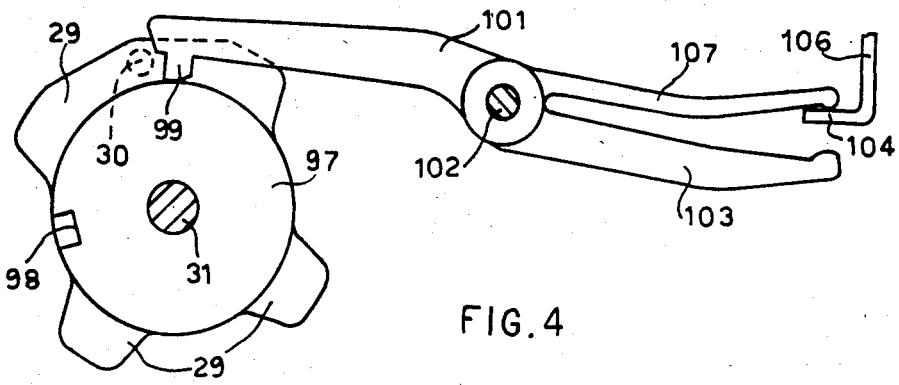
Figure 5:
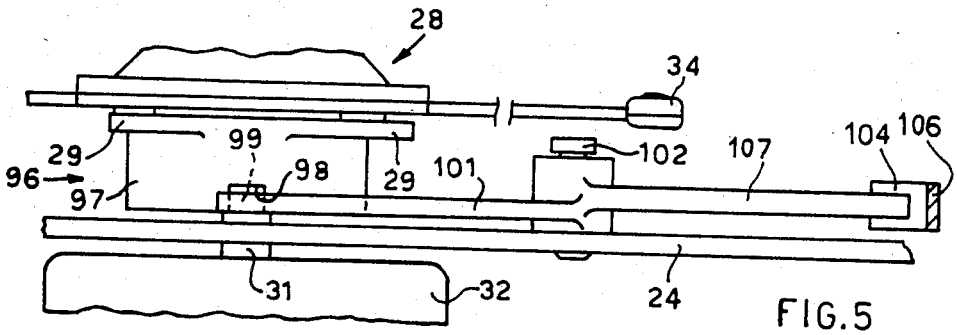

FIG. 3 shows a front view of part of some details from FIG. 1, on an enlarged scale, FIG. 4 shows a front view of some of the details from FIG. 3, in an operating position, FIG. 5 shows a plan view of some of the details from FIG. 3, FIG. 6 shows a logic block circuit diagram of a control and regulating unit of the machine shown in FIG. 1, and FIG. 7 is a front view of part of an alternative form of the construction shown in FIG. 4.

Figure 2:
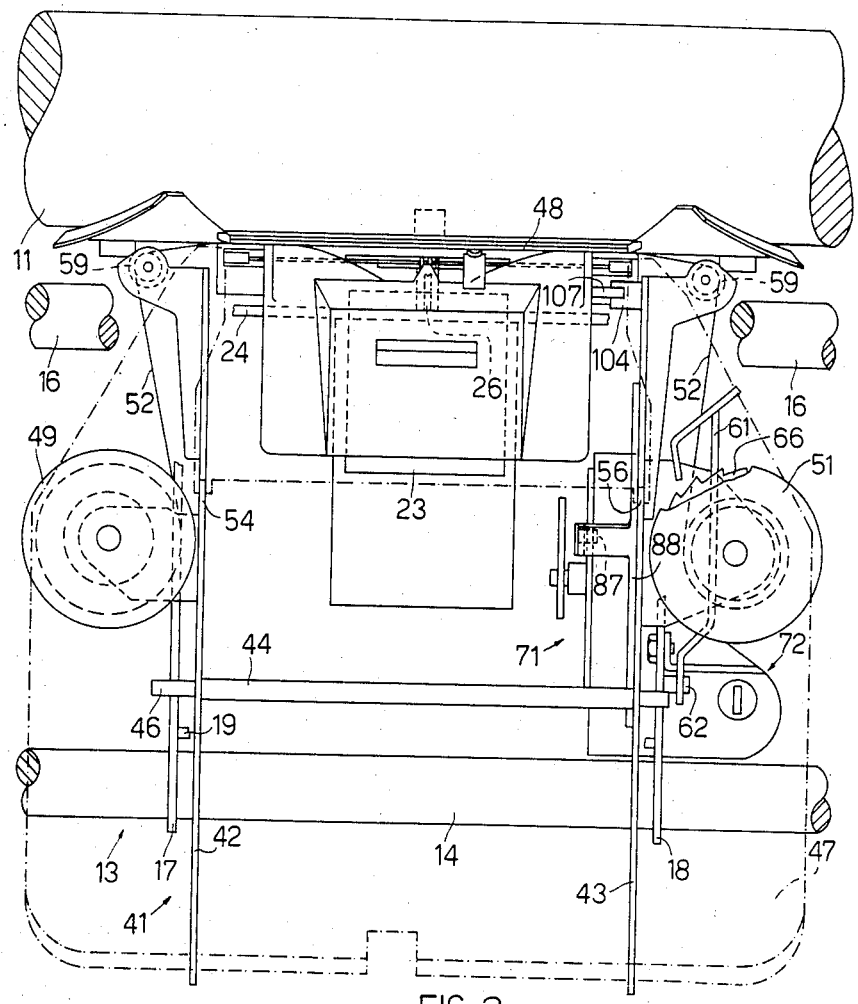
FIG. 2 shows a plan view of part of the machine shown in FIG. 1.

The device is applied to an electronically controlled typewriter comprising a typing assembly having a roller 11 (FIGS. 1 and 2) for carrying a page of typing 12, and a carriage which is generally denoted by reference numeral 13 and which is movable transversely with respect to the page of typing 12 along two guides 14 and 16 and which carries a character-carrying disc or 'daisywheel' 28. The carriage 13 is slidable along the guides 14 and 16 in both directions and is displaced for example by an electric stepping motor (not shown in the drawings) and as described in the U.S. Pat. No. 3,707,214 assigned to Ing. C. Olivetti & C., S.p.A. and incorporated herein by reference. The carriage 13 comprises two side members 17 and 18 which are connected by transverse members 19, 21 and 22. A solenoid 23 which is fixed to an upright 24 which in turn is pivotally mounted on the guide 16 activates a hammer 26 for printing the characters 34 of the 'daisywheel' 28 by way of a typing ribbon 48, or for cancelling a character which has already been typed, by means of a correction ribbon 52.

The daisywheel 28 is removably fixed to a flange 29 on a selector shaft 31 in a predetermined angular position by means of a pin 30 (see FIGS. 3, 4 and 5) and a device which is not shown but which is for example described in the U.S. Pat. No. 4,036,348, assigned to Ing. C. Olivetti & C., S.p.A. and incorporated herein by reference. The shaft 31 is rotated intermittently by an electric stepping motor 32, for example of the two-phase type, having a hundred angular steps, being fixed to the upright 24 and controlled by an electronic unit described hereinafter.

The two ribbons 48 and 52 (see FIGS. 1 and 2) have their active portions substantially in a coplanar condition and are normally held in a viewing position below the line of typing. The two ribbons 48 and 52 are raised in a differentiated manner, after selection of the desired character, by means of a pair of solenoids, as described in the published British patent application GB 2 030 076 or by means of a motor as described in the published European patent application EP 0 038 215.

In both cases, a ribbon lifting frame 41 is mounted on the carriage 13 and comprises two side plates 42 and 43 which are fixed to a sleeve 44 and by means of which the support frame 41 is pivotally mounted on a spindle or shaft 46 on the carriage 13. The frame 41 carries a cartridge 47 for the typing ribbon 48 and two spools, a feed spool 49 and take-up spool 51, on which the correction ribbon 52 is wound. The cartridge 47 for the typing ribbon 48 is substantially the same as that described in U.S. Pat. No. 4,010,839, assigned to Ing. C. Olivetti & C., S.p.A. and incorporated herein by reference, and is mounted removably on the frame 41 by means of a leaf spring 53, against two shoulders 54 and 56 on the plates 42 and 43.

The correction ribbon 52 is guided between the two spools 49 and 51 by means of two ribbon guides 59 in such a way as to remain disposed below the typing ribbon 48 and parallel both to the ribbon 48 and to the platen roller 11. A pawl member 61 is pivotally carried on a pin 62 on the side member 18, to co-operate with a toothed wheel 66 of the take-up spool 51 and to cause the correction ribbon 52 to feed forward when the frame 41 is moved into the higher position for selection of the correction ribbon 52. The lifting movement of the ribbons 48 and 52, which is described in U.S. Pat. No. 4,472,073, is effected by means of a control member 71. The control member 71 also operates on a mechanism 72 for forward feed movement of the typing ribbon 48.

The control member 71 comprises a disc 77 having an externally toothed rim (see FIG. 1) engaged with a pinion 78 of a bi-directional electric motor 79. On its face, the disc 77 comprises a pair of cam grooves having a common profile portion 83 which is connected to two eccentric profile portions 84 and 86 which are interconnected and spaced from each other. The profile portions 84 and 86 are arranged to accommodate a pin 87 of a cem follower 88 which is fixed to the plate 43. Only one of the two profile portions 84 and 86 can be engaged by the pin 87, in dependence on the direction of rotation of the disc 77. The disc 77 also carries the movable part of a transducer 91, the output signals of which, at the terminals 89, provide the relative angular position thereof.

If the disc 77 rotates in the clockwise direction, the pin 87 engages the eccentric portion 84 which is of smaller height, and the cam follower 88 moves the frame 41 into an intermediate typing position, with the typing ribbon 48 positioned in front of the point of typing. Conversely, if the disc rotates in the anticlockwise direction, the pin 87 engages the eccentric portion 86 which is of greater height, moves the frame 41 into a raised correction position, and positions the correction ribbon 52 in front of the point of typing.

The typewriter is controlled by an electronic unit 149 (see FIG. 6) comprising a master microprocessor 150 and a series of slave microprocessors 151, 152 and 153. The microprocessors are timed by a unit 155 and are connected together by means of data and address lines 154 to which there is also connected an input unit 156 comprising a keyboard or other type of interface. The information from the input unit 156 is recognised by the master microprocessor 150 which activates the slave microprocessors for carrying out the required functions.

The microprocessor 151 controls the motor 32 for selecting the characters of the daisywheel 28 and the microprocessor 152 controls the motor 79 for the ribbon functions 48 and 52, the strike solenoid 23 and a motor 158 for line spacing of the platen roller 11. The slave microprocessor 153 and other microprocessors which are not shown in the drawings respectively control the movement of the carriage 13 along the line of printing, alternatively to the method described in above-mentioned U.S. Pat. No. 3,707,214 and other functions of the typewriter which are not relevant to the subject-matter of the present invention.

The characters 34 (see FIG. 3) are distributed around the daisywheel 28 in accordance with a predetermined order, for example from 1 to 99, starting from a zero or reference petal represented by the underlining character '—'. The zero petal is delimited by an external configuration of arrowhead shape, and indicates the point of typing when it is positioned in front of the hammer 26. The slave microprocessor 151 (see FIG. 6) is capable of storing, in a register 160 thereof, a code which is unequivocally associated with the ordinal number of the character which is positioned in front of the hammer or striker 26.

In response to fresh information from the unit 156, the master microprocessor 150 converts the received command into a code relating to the ordinal number of the character to be selected. The new code is stored in the register 160 while the old code is temporarily transferred into a register 161. The microprocessor 151 compares the codes of the two registers 160 and 161 and determines the number of angular steps required for positioning the new character, in the direction of the shortest length of arcuate movement. Then, on the lines 164, the microprocessor 151 produces a series of signals for pilot control of the motor 32. The combination of those signals and the timing thereof are obtained from reading a table 162 which takes account of the number of phases of the motor 32 and the angular stepping motion thereof.

A sequencing circuit 146 responds to the signals on the lines 164 and supplies the logic control signals to a power circuit 157 which drives the windings 169 of the stepping motor 32 for the consequent rotary movement of the daisywheel 28. The various details for achieving that are not part of the subject-matter of the present invention and are therefore omitted for the sake of brevity. The result of the above-indicated logic operations is that the desired character is moved into and stopped in a position in front of the point of typing, in the shortest period of time compatible with the characteristics of the motor used.

When the typing position has been reached, the rotor of the motor 32 is held in the final position, with the windings thereof being activated with a holding current which is of lower strength than that used for the rotary motion, being selected by a suitable command on an input 166 of the power circuit 157.

Subsequently, the slave microprocessor 152, by means of a switching unit 170 and a power circuit 171, causes rotary movement of the service or operating motor 79 in the appropriate direction for selecting the typing ribbon 48 or the correction ribbon 52. When the transducer 91 signals on the lines 89 that the frame 41 has been raised, for correct positioning of the selected ribbon, the microprocessor 152 activates the solenoid 23 by means of a power circuit 172 to cause the selected character to be printed or erased. The microprocessor 152 then operates to return the frame 41 to a rest position for a subsequent printing or correction cycle.

Upon starting up the machine, the registers 160 and 161 are zeroed, independently of the effective position of the daisywheel. The machine therefrom provides an initialisation phase which is activated by a circuit 165 which synchronises the content of the register 160 with the ordinal number of the character disposed in front of the hammer. For that purpose, the microprocessor 151 comprises a table 173 in which are stored the information in respect of rotary movement at low speed and in the clockwise direction of the motor 32, corresponding to one hundred angular steps of the daisywheel 28.

In accordance with the invention, the device for zero positioning of the daisywheel 28 is indicated by reference numeral 96 (see FIGS. 3 and 5), and comprises a rotary abutment or stop formed by a sleeve 97 fixed to the flange 29 and on the outside periphery of which is disposed a seat 98 capable of receiving a tooth 99. The tooth 99 is disposed on an end portion of an arm of a rocking lever 101 which is pivotally mounted on a pin portion 102 on the upright 24. A second arm 103 of the lever 101 is associated in the upper part thereof with a resilient tongue portion 107 having a spring function. In the alternative construction shown in FIG. 7, the arrangement provides a lever 107' which is pivotally mounted on the pin portion 102 and which is connected to the arm 103 by means of a spring 105. Also provided on the sleeve 97 is a lead-in recess or depression of spiral configuration, to facilitate engagement of the tooth 99 with the seat 98 when the sleeve 97 rotates in the clockwise direction. The ends of the arm 103 and the tongue portion 107 or 107' engage a tab 104 of an arm 106 carried by the plate 43 (see FIG. 2) of the ribbon lifting frame 41.

The mode of operation of the device 96 is as follows:

Whenever the machine is started, the initialisation circuit 165 is automatically actuated, the information from the circuit 165 taking priority over that from the input unit 156 (see FIG. 6) and activating the microprocessor 150 for an initialisation cycle. The various volatile memories are all reset and the slave microprocessor 151 is activated for a series of preliminary current switching operations, in relation to the windings 169 of the motor 32. The switching operations stop the rotor in a preferential phase in accordance with a preset configuration of activation of the windings 169.

The microprocessor 152 is then activated to select the correction ribbon 52 in a position in front of the point of typing. That is carried out, in the manner already described above, by means of an anticlockwise rotary movement of the disc 77 (see FIG. 1) which brings the eccentric profile portion 86 into engagement with the pin 87 of the cam follower 88. The frame 41 is thus rotated into its correction position while the disc 77 is stopped in response to the signals indicating selection has taken place, as supplied by the transducer 91.

By virtue of the lifting movement of the frame 41 and thus the plate 43 and the arm 106, the tab 104 (see FIG. 3) rotates the lever 101 in the anticlockwise direction and moves the tooth 99 towards the sleeve member 97 from the position shown in solid lines to the position shown in broken lines in FIG. 3. If the seat 98 is not disposed in line with the tooth 99, the tooth 99 bears against the outside surface of the sleeve member 97 (see FIG. 4), the tongue portion 107 flexes and causes the tooth 99 to be pressed against the sleeve member 97.

The master microprocessor 150 (see FIG. 6) now activates the slave microprocessor 151 for a cycle for zeroing the daisywheel 28. That is effected to sequentially activating the windings 169 of the motor 32, with a reduced current selected by the line 166 which rotates the daisywheel 28. Those current switching actions are no longer controlled by the two registers 160 and 161, the content of which no longer has any relationship to the actual position of the daisywheel 28, but are programmed at reduced speed by the timing unit 155 and the table 173 and would cause a complete rotary movement (100 angular steps) of the daisywheel 28.

As long as is possible, the rotor of the motor 32 drive the selection shaft 31 (see FIG. 5) and the sleeve member 97 in rotation. When the seat 98 is positioned below the tooth 99, the resilient effect of the tongue portion 107 causes the tooth 99 to come into engagement with the seat 98, and causes the daisywheel 28 and the rotor of the motor 32 to stop. However, the switching of current between the windings of the motor 32 continues in accordance with the commands received from the microprocessor 151 but obviously, without that having any effect on the position of the daisywheel. The low speed selected and the modest current for exciting the windings of the motor however avoid damage to the moving parts. The daisywheel 28 when thus stopped by the tooth 99 is then disposed in the zero position shown in FIG. 3.

After a number of current switching actions sufficient for a rotary movement through 360°, or after a predetermined period of time which is longer than that required for the slow complete rotary movement of the sleeve member 97, the daisywheel is certain to be in its zero position. The microprocessor 150 then again accesses its registers 160 and 161 and loads them with the code of the zero position. It also activates the windings 169 of the motor with a configuration such as to define a phase of the rotor to which the zero position of the daisywheel corresponds.

In a subsequent period of time, the microprocessor 152 reactivates the motor 79 to complete the rotary movement of the disc 77 in its clockwise direction, until it is in its rest position. The pin 87 (see FIG. 1) is then displaced downwardly to put the frame 41 in the viewing position. The resulting downward movement of the limb portion 104 (see FIG. 3) and the engagement thereof with the arm 103 of the lever 101 positively cause rotary movement of the lever in the clockwise direction, and disengagement of the tooth 99 from the seat 98. The angular position of the daisywheel 28 is now synchronised with the code in the register 160 and the machine is ready for typing.

During the typing cycles of the machine, the device 96 does not interfere in any way with selection of the characters. The lifting movement of the frame 41 for selection of the typing ribbon 48 is in fact insufficient to move the tooth 99 into contact with the outside surface of the sleeve member 97, whereby the frame 41 can remain motionless in its typing position even during repeated typing cycles. When carrying out a print operation for correction purposes, in which the frame 41 has to be successively raised and lowered in each cycle, for activating the ribbon feed mechanism, the microprocessors 150, 151 and 152 rotate the shaft 31 only when the tooth 99 is certainly disengaged from the sleeve member 97, that being before the lifting movement of the frame 41 and after the downward movement of the frame.

It will be appreciated that the above-described device may be the subject of various modifications, improvements and addition of parts, without departing from the scope of the invention.

For example, instead of the motor mechanism for positioning the ribbons 48 and 52, it is possible to use the mechanism which is actuated by two solenoids, as described in above-mentioned published application GB 2 030 076. In that case, zeroing of the daisywheel requires continued energisation of the correction ribbon selection solenoid before and during the reduced-speed rotary movement of the daisywheel.

It will also be clear that the device is equally well applied to machines which have the correction ribbon carried by a frame which is independent of that which carries the typing ribbon and controlled by an independent member.

In machines which do not have correction devices but in which each typing cycle requires the ribbon to be raised from the viewing position to the typing position, the zeroing action may be effected by means of the command for lifting the typing ribbon, with the precaution that, during the typing cycles, the ribbon is raised only after the character has been selected and the character-carrying member has stopped.

Another alternative construction provides for using a sleeve member 97 or other element provided with a stop element fixed to the daisywheel 28 rather than to the shaft 31. The assembly of the sleeve member and the daisywheel may be removably connected to the output shaft of the motor 32 by means of a toothed portion thereof engageable with a corresponding toothed portion of the shaft 31, which permits correct phase positioning of the daisywheel.

It is also possible to use the same device in positioning systems which are controlled in a closed loop mode but which do not have any zero detector. In that case, the microprocessor zeroes the character-carrying member by causing it to rotate slowly and by monitoring the generation of the signals indicating the occurrence of movement. The absence of fresh movement signals, in a predetermined period of time subsequent to actuation of the stop tooth, will indicate that the daisywheel has been stopped and will cause synchronisation of the position counter.

Another alternative construction provides for actuating the stop element of the character-carrying member not in dependence on the lifting movement of the ribbon but in dependence on its forward feed movement, as may occur when the forward feed movement of the typing or correction ribbon is controlled by an electromagnetically actuated pawl mechanism. During the initialisation phase, continuous energisation of the solenoid will cause the fixed stop element to move into the path of movement of the rotary stop element and will cause the character-carrying member to stop in its zero position. In the typing cycles, selection of the character will however precede actuation of the solenoid for moving the ribbon.

I claim:

1. An electronic typewriter comprising a platen which defines a typing point, a carriage which is movable parallel to the platen and supporting a character-bearing disc having a series of flexible laminae each carrying a character, a driving means consisting of a selector motor with windings for selectively rotating the character-bearing disc, a correcting ribbon, means comprising a control member and a ribbon supporting frame for lifting the correcting ribbon up to a position in front of said typing point, memory means for storing the angular position of the character-bearing disc with respect to the typing point, means for performing a correction cycle including, in the following order, the selection of a desired character of the character-bearing disc in front of the typing point, the actuation of said control member and the striking of the desired character against the platen through said correction ribbon, and zeroing means for positioning the character-bearing disc in a zero position at any point of the carriage movement along the platen, said zeroing means comprising;

means for performing an initialization cycle for said selecting motor and said control member;

a stop member including a single stop surface rotatable together with the given path, wherein said single stop surface is univocally associated with said zero position of the character-bearing disc;

means for arresting the character-bearing disc in its zero position consisting of.

a toothed member operatively connected with the ribbon lifting frame and having a tooth cooperative with the single stop surface of said stop member first means controlled by said means for performing an initialization cycle for actuating said control member to lift the ribbon lifting frame in the correcting position and for causing the toothed member with its tooth to be moved toward the path of the single stop surface of the stop member during the initialization cycle;

second means also controlled by said means performing an initialization cycle for driving the selecting motor with a reduced current and a reduced speed to rotate the character-bearing disc jointly with actuation of said control member until the tooth engages the single stop surface and causes the character-bearing disc to be stopped at its zero position; and wherein the reduced current on said windings and the reduced speed of said motor are selected to avoid damage to the moving parts, arrested by the action of said tooth on said stop surface;

loading means for loading the memory means with the zero position, said loading means including timing means for revealing a given time sufficient to the arrest of the character-bearing disc by the action said tooth on said stop surface; and execution register means for loading the memory means with said zero position after the elapsing of said given time, and wherein said means for performing a correction cycle comprises means for selecting the desired character in front of the typing point when said tooth is disengaged from said stop surface and actuate said control member only when the selection of the desired character has been completed before the lifting of said ribbon lifting frame during each correction cycle wherein any engagement of said single stop surface with said tooth is avoided during said correction cycle.

2. A typewriter according to claim 1, wherein said means for performing a correction cycle comprise an operating motor and a cam mechanism, wherein the control member is moved by said cam mechanism actuated intermittently by the operating motor, wherein said control member further comprises means for moving a typing ribbon in front of the typing point in dependence on the direction of movement of the operating motor during a selection cycle, and wherein said means for performing an initialization cycle and said first and second means actuate the operating motor after stoppage of the selecting motor during the correction cycles and before the selecting motor starts during the initialization cycles.

3. A typewriter according to claim 1, wherein the selecting motor is of the stepping type and the zero position of the character-bearing disc is associated with a predetermined phase configuration of the windings and wherein said means for performing an initialization cycle comprises means for activating the windings of the selecting motor according to said predetermined phase configuration in association with loading of the memory with the zero position.

4. A typewriter according to claim 1, wherein the given time is defined by a time longer than the time necessary for the character-bearing disc to perform a complete rotation at said reduced velocity and wherein said second means comprises means for actuating the windings of the selecting motor, for a time longer than said given time for causing at least a complete revolution of the character-bearing disc during the initialization cycle.

5. A typewriter according to claim 1, wherein the selecting motor comprises a shaft and the character-bearing disc is of the daisywheel type and can be removably mounted coaxially with the shaft of the selecting motor.

6. A typewriter according to claim 5, wherein the stop member is mounted in an angular predetermined manner on the daisywheel and is removable together with the daisywheel with respect to the shaft of the selecting motor.

7. A typewriter according to claim 5, wherein the stop member is mounted fixedly with respect to the shaft of the selecting motor and in a predetermined angular relationship with respect to the daisywheel.

8. A typewriter according to claim 1, wherein said stop member comprises a sleeve angularly fixed with respect to the character-bearing disc including a substantially cylindrical portion and said single stop surface and wherein said tooth comprises means for bearing against the cylindrical portion, without impeding the rotary movement of the character-bearing disc and engaging said stop surface to define the zero position of the character-bearing disc.

9. A typewriter according to claim 8, wherein said single stop surface is defined by a seat of said cylindrical portion, wherein said first means comprise resilient means yieldably connecting said control member with said toothed member for causing said tooth to bear on the cylindrical portion of said sleeve upon the actuation of said control member.

10. A typewriter according to claim 9, wherein the toothed member comprises a rocking lever and said resilient means comprise a leaf spring element connected to the rocking lever.

11. In an electronic typewriter of the type comprising a platen which defines a point of typing; a carriage which is movable with respect to the platen; a character-carrying member rotatably supported by said carriage and having a series of comprises means for rotating the character-carrying member; selecting means for actuating said selector motor for intermittent rotation of said character-carrying member to select the character to be typed; a zeroing means operatively connected with the character-carrying member for positioning said character-carrying member in a zero position; a memory means for storing the zero position of the character-carrying member with respect to the point of typing; means for loading the memory with the zero position, means comprising a control member for moving a lifting frame and for positioning said zeroing means and operating means for actuating a zero cycle for selector motor and the control member, wherein the selector motor comprises means for rotating the character carrying member, the means for positioning the zeroing means comprises means for arresting arresting the rotary movement of the character-carrying member in the zero position independently of the position of the carriage with respect to the platen, wherein said zeroing means comprises;

a single arrest member which is rotatable together with the character-carrying member along a given trajectory;

a stop element which is capable of arresting the single arrest member only in the zero position of the character-carrying member;

support means mounted on said carriage for movably supporting said stop element between a rest position away from the trajectory of said single arrest member and an operative position interfering with the trajectory of said single arrest member;

an actuating member movable between a rest position and an operating position;

a toothed member connected with said actuating member and having said stop element which comprises means for holding said stop element in the rest position in response to the rest position of the actuating member; and spring means coupling said toothed member with the actuating member for yieldably moving the stop element toward said operative position in response to the operating position of said actuating member during the zero cycle, so that said stop element engages said arrest member and arrests the rotary movement of the character-carrying member in the zero position on any position of the carriage along the platen only when said operating means actuates said zero cycle.

12. A device according to claim 11, wherein said toothed member comprises a rocking lever fulcrumed on said support member and the spring means comprise a leaf spring element connected to the rocking lever.

13. A device according to claim 11, wherein said toothed member comprises a rocking lever supported by said support member and said spring means comprise a further lever and a spring connecting the further lever with said rocking lever.

14. A device according to claim 11, further comprising a sleeve angularly fixed with respect to the character-carrying member including a cylindrical portion and which is provided with the arrest member having a recess and wherein the stop element comprises a tooth capable of bearing against the cylindrical portion without impeding the rotary movement of the character-carrying member and engaging into the recess to define the zero position.

15. A device according to claim 11, wherein the selector motor comprises an output shaft and the character-carrying member is of the daisywheel type and can be mounted removably on the output shaft of the selector motor.

16. A device according to claim 15, wherein the arrest member is mounted in an angular predetermined manner on the daisywheel and is removable together with the daisy wheel with respect to the output shaft of the selector motor.

17. A device according to claim 15, wherein the arrest member is mounted fixedly with respect to the output shaft of the selector motor in a predetermined angular relationship with respect to the daisywheel.

18. An electronic typewriter of the type comprising a platen which defines a typing point; a carriage which is movable parallel to the platen; a character-carrying member rotatably supported by said carriage and having a series of characters; a selector motor means operatively connected with the character-carrying member for rotating said character-carrying member; selecting means for intermittently actuating said selector motor to select a character to be struck against the typing point; ribbon having a portion actuable for being interposed between the typing point and the character to be struck; ribbon actuating means for actuating said portion of said ribbon; means for performing a ribbon use cycle including controlling said selecting means to select the character to be struck, and said ribbon actuating means to interpose said portion of ribbon between the typing point and the character to be struck, said means for performing a ribbon use cycle comprising memory means for storing the angular position of the character-carrying member and means for updating asid memory means in response to rotation of said character-carrying member; and a zeroing means for positioning the character-carrying member in a zero position and for loading the memory means with the zero position, said zero device including;

a rotatable member having a single stop surface which is rotatable together with the character-carrying member along a given trajectory, a stop means actuatable to cooperate with said single stop surface for arresting the rotatable member to position the character-carrying member in the zero position, support means for movably supporting said actuatable stop element between a rest position away from the trajectory of said stop surface and an actuated position interfering with the trajectory of said stop surface;

connecting means for connecting said ribbon actuating means with said actuatable stop element for moving said stop element toward said actuated position, in response to the actuation of said portion of the correcting ribbon; and intialization means for causing said selector motor to be actuated when said ribbon actuating means is actuated for arresting the character-carrying member in the zero position and for loading said memory means with said zero position after a time sufficient to the interference with said stop surface with the stop element at said actuated position; and wherein said means for performing a ribbon use cycle comprises means for causing cycle causes the selecting means to select the character to be struck against the typing point before the actuation of said ribbon actuating means, whereby avoiding any interference of said stop surface with said actuatable stop element during said ribbon use cycle.

19. A typewriter according to claim 18, wherein said rotatable member comprises a sleeve angularly fixed with respect to the character-carrying member and including a substantially cylindrical portion provided with a single recess defining said single stop surface, wherein said connecting means comprises a resilient member for causing said actuatable stop element to yieldably bear on the cylindrical portion into an intermediate position without impeding the rotary movement of the character-carrying member in response to actuation of said ribbon actuating means and wherein said resilient means comprises means for causing the stop element to engage said recess and said stop element to be moved into said actuated position to interfere with the stop surface of said rotatable member to define said zero position.

20. A typewriter according to claim 19, wherein said actuatable stop element comprises a tooth engagable in said recess.

21. A typewriter according to claim 18, wherein said support means are mounted on said carriage.

22. A typewriter according to claim 18, further comprising a rocking lever mounted on said support means and which comprises said actuatable stop element and wherein said connecting means comprises a resilient member connecting the rocking lever with said ribbon actuating means.

* * * * *